US005330558A

United States Patent [19]

McCormick et al.

[11] Patent Number: 5,330,558

[45] Date of Patent: Jul. 19, 1994

[54] METHOD FOR REMOVING CHROMIUM CONTAINING COATINGS FROM ALUMINUM SUBSTRATES

[75] Inventors: David R. McCormick, Madison Heights; Chi-Fan Hsu, Farmington Hills, both of Mich.

[73] Assignee: Henkel Corporation, Plymouth Meeting, Pa.

[21] Appl. No.: 40,793

[22] Filed: Mar. 31, 1993

[51] Int. Cl.[5] ..... C23F 7/00

[52] U.S. Cl. ..... 75/715; 423/53; 75/711; 156/665; 148/253

[58] Field of Search ..... 148/6.16, 6.2; 75/711; 423/53

[56] References Cited

U.S. PATENT DOCUMENTS

| | | | |
|---|---|---|---|
| 2,438,877 | 3/1948 | Spruance | 148/6.16 |
| 2,494,910 | 1/1950 | Spruance | 148/6.16 |
| 2,678,291 | 4/1954 | Spruance et al. | 148/6.16 |
| 2,796,370 | 6/1957 | Ostrander et al. | 148/6.2 |
| 2,796,371 | 6/1957 | Ostrander et al. | 148/6.2 |
| 2,843,513 | 7/1958 | Stricklen | 148/6.2 |
| 2,859,144 | 8/1958 | Jeremias | 148/6.2 |
| 2,859,147 | 11/1958 | Jeremias | 148/6.16 |
| 4,146,410 | 3/1979 | Reinhold . | |
| 4,500,350 | 2/1985 | Meussdoerffer | 423/53 |
| 4,668,483 | 5/1987 | Ladd | 423/53 |
| 4,966,760 | 10/1990 | Ladd | 423/53 |

*Primary Examiner*—Peter D. Rosenberg

*Attorney, Agent, or Firm*—Ernest G. Szoke; Wayne C. Jaeschke; Daniel S. Ortiz

[57] ABSTRACT

The invention is a process for removing a chromium containing coating from an aluminum article. The chromium containing coating is removed from the aluminum article by contacting the aluminum article having the chromium containing coating with an alkaline treating bath to form an ultrasonically removable chromium containing coating and treating the aluminum article with the ultrasonically removable coating with ultrasonic vibrations to remove the chromium containing coating.

20 Claims, No Drawings

METHOD FOR REMOVING CHROMIUM CONTAINING COATINGS FROM ALUMINUM SUBSTRATES

FIELD OF THE INVENTION

The invention is a method for removing chromium containing conversion coatings from aluminum substrates.

BACKGROUND OF THE INVENTION

Chromium containing coatings are applied to aluminum substrates to provide corrosion protection and to improve the adhesion of organic coatings to the aluminum substrate.

The methods for applying chromium containing coatings to aluminum substrates were developed and brought to commercialization in the early forties. The early processes are disclosed in publications such as U.S. Pat. No. 2,438,877, U.S. Pat. No. 2,494,910, U.S. Pat. No. 2,678,291, and U.S. Pat. No. 2,859,147. These processes are still used today as can be seen from U.S. Pat. No. 4,668,305 which is an improvement in the earlier processes. The earliest processes were concerned with applying a chromium phosphate containing coating to an aluminum substrate.

Another commercial process for applying a chromium containing coating to an aluminum substrate was developed in the early 1950's and did not require the presence of a phosphate ion in the coating bath. Processes of this type are disclosed in U.S. Pat. No. 2,796,370, U.S. Pat. No. 2,796,371, U.S. Pat. No. 2,843,513, and U.S. Pat. No. 2,859,144. An improvement in these process was patented as late as 1979 as evidence by U.S. Pat. No. 4,146,410. The disclosures of the chromium phosphate containing coating and chromium oxide containing coating process patents are incorporated herein by reference.

All of these processes are known to provide coatings which improve the corrosion resistance and improve the organic coating adhesion of aluminum substrates.

RELATED ART

A chromium containing coating on an aluminum article improves the corrosion resistance of the aluminum article. To provide enhanced corrosion resistance and organic coating adhesion, the chromium containing coating must be applied uniformly to the surface of the aluminum article. However, in commercial coating operations due to difficulties with the precleaning operation or with the coating operation, the chromium containing coatings are not always uniform and the corrosion protection and organic coating adhesion is not uniform over the surface of the aluminum article.

The nonuniformity of the coating which can occur during commercial production, provides aluminum articles with improved corrosion resistance and improved organic coating adhesion only over a portion of the surface of the aluminum article, and the organic coating has a variable adhesion to the aluminum substrate. The aluminum articles with the uneven chromium containing coating are generally not commercially acceptable. Until this time, there was no commercially acceptable method for removing the chromium containing coating or the chromium containing coating which had been overcoated with an organic coating from the surface of an aluminum article.

It is known that if a chromium containing coating has been recently applied (less than 24 hours), the coating can be removed by contact with a nitric acid solution containing about 30 to 35% nitric acid. However, if the chromium containing coating is applied more than about 24 hours before attempted removal, a 30 to 35% nitric acid solution is not capable of satisfactorily removing the chromium containing coating from the aluminum substrate. Under these circumstances the chromium containing coating can be removed from an aluminum substrate by contacting the coated substrate with a molten metal salt such sodium nitrite. However, this removal process is difficult, expensive, and is relegated to laboratory methods for measuring the amount of chromium which is deposited on a substrate by the various processes.

It was also known that the chromium conversion coating or the chromium conversion coating overcoated with an organic coating can be removed from the aluminum article by aggressive treatment of the coated aluminum article with a strong alkali metal hydroxide solution at an elevated temperature. However, the combination of a strong alkali metal hydroxide solution and an elevated temperature results in substantial attack on the aluminum, causing pitting, etching, embrittlement, smutting and staining. Aluminum articles treated with strong alkali metal hydroxides at elevated temperatures are generally not satisfactory for reprocessing in the chromium containing coating operation and subsequent overcoating with an organic coating material. In particular, the aggressive treatment of the aluminum article results in etching, pitting, embrittlement, smutting and staining with dissolution of large amounts of aluminum which is undesirable for providing an attractive surface to the aluminum article.

The inability to recover and recycle unsatisfactorily chromium containing coated aluminum articles and chromium containing coated aluminum articles with an organic overcoating results in a large expense to a manufacturer of aluminum articles which must be corrosion protected and coated with an organic coating material.

BRIEF DESCRIPTION OF THE INVENTION

According to the present invention a chromium containing coating can be removed from an aluminum article by a process which comprises: contacting an aluminum article, having a chromium containing coating, with an aqueous alkaline treating solution at a pH of at least 10 preferably an alkali metal hydroxide or alkali metal salt of a weak acid for a sufficient length of time to form an aluminum article with an ultrasonically removable chromium containing coating; and treating the aluminum article with the ultrasonically removable coating, with ultrasonic vibrations to remove the chromium containing coating as particulate matter.

The process can be carried out in a single zone in which ultrasonic vibrations are applied to the coated aluminum article in the zone in which the aluminum article with the chromium containing coating is contacted with an alkaline treating solution. Alternately, the aluminum article with the ultrasonically removable coating is treated in an ultrasonic treating zone separate from the alkaline solution treating zone.

In an alternate embodiment an aluminum article with an ultrasonically removable coating can be treated to remove the coating and desmutted in an ultrasonic treating zone containing a desmutting solution.

The process of the present invention is particularly useful in that the chromium containing coating need not be dissolved in the reagent and the particulate material containing the chromium containing coating can be readily recovered by a physical separation method. The process does not require large volumes of aqueous solution which require extensive treatment before disposal to remove contamination with heavy metals.

The concentration and pH of the alkaline treating solution is adjusted in accordance with the temperature of the solution to provide an ultrasonically removable chromium containing coating on the aluminum article in a reasonable time without aggressively attacking the aluminum article. Higher concentrations of reagents can be utilized at lower temperatures to prevent aggressive attack on the aluminum article.

The method is particularly useful for removing a chromium containing coating from delicate or complex parts or assemblies which are not suitable for aggressive chemical treatment or rough physical treatment.

DETAIL DESCRIPTION OF THE INVENTION

The process of the present invention is particularly useful for removing a chromium containing conversion coating or chromium containing conversion coating having applied thereto an organic coating, from an aluminum article. The process is particularly useful for reclaiming aluminum articles whose coating is not commercially useful. That is, a chromium containing coating which does not adequately cover the aluminum article to provide uniform improved corrosion resistance or uniform improved organic coating adhesion. A chromium containing coating can be too thin, or can be incomplete and only cover portions of the surface of the aluminum article such as islands in a sea. The process of the present invention can also be utilized to remove the organic coating and the chromium containing coating from aluminum articles which have had a organic coating applied over the chromium containing coating which organic coating is not satisfactory.

The process of the present invention is useful in that a chromium containing coating can be removed from the aluminum article but also a chromium containing coating which has been coated with an organic coating can also be readily removed from an aluminum article. The process of the present invention can be utilized to remove chromium containing coatings from aluminum articles which chromium containing coatings have been in place on the aluminum articles for more than 24 hours. The process of the present invention can remove the chromium containing coatings from aluminum substrates which coatings have been in place for extended periods.

As used herein the term "chromium containing coatings" refers to chromium conversion coatings which can be of the chromium phosphate type, chromium oxide type or the variations which are applied according to the chromium conversion coating art. The term "chromium containing coatings" also encompasses chromium conversion coatings which have been overcoated with an organic coating.

As is well understood in the art, chromium conversion coatings are extremely difficult to remove from substrates, particularly aluminum substrates, to which they have been applied without undue damage to the aluminum substrate.

The first step of the process of the present invention is contacting the aluminum article, which is coated with the chromium containing coating to be removed, with an alkaline treating solution at a pH above about 10. The temperature of the solution is generally in the range from about 15° C. to about 90° C., preferably 20° C. to about 80° C. and more preferably 25° C. to about 80° C. The temperature and the concentration of the solution are adjusted to achieve formation of an ultrasonically removable coating in a reasonable time. The concentration and temperature of the solution must be in a range that the solution does not aggressively attack the aluminum article to cause pitting, etching, embrittlement, smutting or staining.

The alkaline treating solution preferably comprises an alkali metal hydroxide and/or an alkali metal salt of a weak acid. The concentration of the alkaline material in the solution is generally from about 0.2% to about 20% by weight, preferably from about 0.2% to about 10% and most preferably from about 0.5% to about 7%. The pH of the solution is greater than about 10 preferably above about 11 and more preferably above about 12. To use a solution with a low concentration of an alkali metal hydroxide or alkali metal salt of a weak acid of about 0.2% to about 2% by weight, the temperature of the solution should be in the upper portion of the useful temperature range to achieve formation of an ultrasonically removable coating in a reasonable time period. The preferred alkali metal hydroxides are sodium hydroxide and potassium hydroxide. As used herein an alkali metal salt of a weak acid refers to alkali metal carbonates, phosphates, pyrophosphate, borates, acetates, propionates and the like.

The preferred alkaline treating solutions useful in the practice of the invention are solutions containing alkali metal hydroxides, alkali metal salts of weak acids which provide a sufficiently high pH to provide the ultrasonically removable coating when the chromium conversion coated aluminum article is contacted with the solution. However, other alkaline materials such as amines and quaternary ammonium compounds can also be used in the process to form the alkaline treating solution as long as they can provide a suitable pH and do not produce undesirable or excessive pitting and etching of the aluminum surface. Preferably the alkaline treating solution does not solubilize the chromium containing coating. Sodium silicate solutions can be used to loosen the chromium containing coating but is not preferred since it solubilizes the chromium containing coating.

The alkali metal hydroxide or salt of a weak acid solution can also contain agents for buffering the pH of the solution. Surfactants which are stable in alkaline solutions can be present to increase the wetting ability of the solution to permit more rapid penetration of an organic coating and attack on the bond between the chromium containing coating and the aluminum substrate to more rapidly form the ultrasonically removable coating. The preferred alkali metal hydroxide or alkali metal salt of a weak acid treating solution can also contain chelating agents to aid in sequestering contaminating metal ions which could make the treatment ineffective and require frequent changes of the solutions in the treating bath.

The aluminum substrate with the chromium containing coating is generally contacted with the alkaline treating solution for from about 15 seconds to about 30 minutes. The longer treatments are required when the solution is of a low concentration and the pH and temperature are relatively low. The concentration and temperature of the alkaline treating solution can be adjusted to achieve rapid formation of the ultrasonically removable chromium containing coating in a reasonable time period without aggressive attack on the aluminum article with extensive etching, pitting, embrittlement, staining and smutting.

The soluble chromium ion content of the alkaline treating solution remains low throughout the life of the solution since the chromium containing coating is preferably not soluble in the alkaline treating solution at the concentration and temperature utilized in the process.

As the alkaline treating solution is contacted with the aluminum articles, the amount of soluble aluminum in the solution increases. It is believed that the increase in the aluminum in solution is due to a reaction of an aluminum containing interface composition between the chromium containing coating and the aluminum substrate. Although the concentration of aluminum in the alkaline treating solution increases during use, the aluminum articles do not show any extensive etching, pitting, embrittlement, smutting or staining due to contact with the solution.

The aluminum article with the chromium containing coating can be contacted with the alkaline treating solution by dipping, spraying, flowing, brushing or any other means for contacting a solid with a liquid. Preferably the aluminum article is contacted with the alkaline solution by dipping or spraying.

Any surfactant present in the alkaline treating solution must be compatible with and stable in the solution. Anionic, amphoteric, ampholytic and nonionic surfactants are generally useful for inclusion in the alkaline treating solution. Surfactants such as organic phosphate and phosphonate anionic surfactants, fluorinated anionic surfactants, organic sulfonate and sulfate surfactants can also be used provided they are stable and compatible with the alkaline solution. Amphoteric and ampholytic surfactants can also be useful in the practice of the invention. Nonionic surfactants can also be useful in the practice of the invention. Any surfactant which is stable in the alkaline solution and is not harmful to the aluminum substrate can be used in the practice of the invention. It is preferred that the surfactant be a low foaming or moderate foaming surfactant. As used herein a low foaming surfactant has a foam height of 60/30 mm and a moderate foaming surfactant has a foam height of 100/60 mm according to the Shaking Test Method.

Shaking Test Method

A glass stoppered 250 milliliter measuring cylinder, about 30 millimeters in diameter, is filled to the 150 milliliter mark with a 0.1% by weight solution of the surfactant in water at room temperature. The measuring cylinder is stoppered then vigorously shaken for 30 seconds. The foam height immediately after shaking is measured, and the foam height is measured again 30 seconds after shaking is completed. A foam height of 60 millimeters or less after shaking or 30 millimeters or less 30 seconds after shaking is considered a low foaming surfactant. A foam height of 60–100 millimeters immediately after shaking or 30–60 millimeters 30 seconds after shaking is considered a moderate foaming surfactant.

Anionic surfactants such as TRITON ®DF-20, TRITON ®DF- 16, TRITON ®H-66, TRITON ®QS-44, MONATROPE 1296, and RHODAFAC ®RM 710 can be useful. Amphoteric surfactants such as MONATERIC ®LF-100, MONATERIC ®CEM-38%, and MONATERIC ®CyNa 50% can be useful. Nonionic surfactants such as PLURONIC ®L-61, TRITON ®X-102, TRITON ®X-100 and PLURAFAC ®D-25 can be used. Surfactants such as alkylpolyglycosides, alkylethoxylates, fatty alcohol ethoxylates, fatty acid amidoethoxylates and the like can be useful in the practice of the invention.

The addition of the surfactants to the alkaline treating solution aids in penetration of any organic coating which is formed over the chromium containing coating and in penetration of the chromium containing coating. The addition of the surfactants aids in reducing the required contact time between chromium containing coated aluminum article and the alkaline treating solution and in addition assures that the ultrasonically removable coating has been formed more evenly over the surface in a shorter time.

The alkaline treating solution can also contain metal chelating agents which can reduce contamination of the treating solution with unwanted metal precipitates. The chelating agent should be stable in the alkaline solution and in addition be able to chelate the ions of the metal which is required to be chelated or sequestered. Chelating or sequestering materials such as sodium gluconate, polyphosphates, pyrophosphates, phosphate esters, NTA and EDTA can be useful in the practice of the present invention. The nature of chelating agent or sequestering agent is not critical as long as it is stable in the alkaline solution, does not interfere with operation of the alkaline treating solution and adequately sequesters the desired metal ions. The chelating or sequestering agents are sometimes necessary when treating aluminum articles which are alloyed with certain metals which tend to collect in the alkaline treating solution. If the metals are not soluble in the alkaline treating solution, the metals need not be chelated or sequestered but can be eliminated from the treating bath by means known for separating solid particulate material from aqueous solutions.

After the aluminum article coated with the chromium containing coating and/or organic coating over the chromium containing coating is treated to form the ultrasonically removable coating, the aluminum article is then passed to an ultrasonic treating zone. Optionally, the treated article can be rinsed before it is subjected to the ultrasonic vibrations in the ultrasonic treating zone.

The ultrasonic treating zone comprises means for applying ultrasonic vibrations, to the aluminum article with the ultrasonically removable coating. The ultrasonic vibrations are generally applied at a frequency in the range of from about 20 kilohertz to about 100 kilohertz. Preferably from about 20 kilohertz to about 50 kilohertz. The most effective frequency range can be determined by subjecting articles, with an ultrasonically removable coating, to ultrasonic vibrations of different frequencies and observing the frequency or frequency range which is most effective for removing the coating.

In an alternative embodiment, the aluminum article with the chromium containing coating can be contacted with the alkaline treating solution and simultaneously subjected to ultrasonic vibrations in a single treating zone.

The ultrasonic treatment comprises subjecting the aluminum article with the ultrasonically removable coating to ultrasonic vibrations. Preferably, the aluminum article is immersed in an aqueous bath and subjected to the ultrasonic vibrations while it is submerged in the bath. Preferably, the aqueous bath comprises only water. However, minor amounts of surfactants and sequestering agents can be included in the ultrasonic treating bath. Preferably, the ultrasonic treating bath is a water bath and the chromium containing coating is removed from the aluminum article by the ultrasonic vibrations as fine particulate matter. The chromium containing coating is not soluble in the aqueous treating bath and can be readily filtered from the treating bath and recovered or disposed of as required.

In another preferred embodiment the aqueous ultrasonic treating bath contains sufficient alkaline material to comprise the alkaline treating solution and formation of the ultrasonically removable coating and removal of the coating occurs in one treating zone. If the initial treatment with the alkaline treating solution to form the ultrasonically removable chromium containing coating, forms a smut on the surface of the aluminum article (generally alloys of aluminum containing metals such as copper, manganese, chromium and zinc), the article can be further treated by known deoxidizers or chromium containing baths to remove the smut. However, a major portion of the smut is removed by the ultrasonic treatment.

In an optional embodiment of the invention, the ultrasonic treating bath comprises an aqueous smut removing solution. These solutions are well-known in the art and comprise a combination of acids and deoxidizers such as nitric, sulfuric, phosphoric and hydrofluoric acid with nitrites, persulfates, hydrogen peroxide and chromates. The combination of removing the chromium containing coating and desmutting in one treating zone is advantageous. The use of a desmutting solution as the liquid in the ultrasonic treating zone is an advance in the art since the aluminum article is removed from the process and after rinsing is ready for application of a chromium containing coating and optionally overcoating with an organic coating material.

The easy removal of the chromium containing coating by the process of the invention is unexpected since the coating before alkaline solution treatment is resistant to removal by ultrasonic vibration. The ultrasonically removable coating cannot be adequately removed by immersion, rinsing, spraying or the like alone. The ultrasonic vibration treatment is necessary to remove all of the coating. The process is particularly useful for recycling delicate parts or assemblies which have been coated with a chromium containing conversion coating. Contact of the aluminum article with a dilute acid solution does not provide an ultrasonically removable coating.

The advantages of the process of the present invention will become immediately apparent from the following examples.

EXAMPLE 1

An aluminum heat exchanger assembly for an air conditioning system having a tube of 3003 aluminum alloy, fins of 3003 aluminum alloy and brazing parts of 4004 and 4015 aluminum alloy, was cleaned with a standard industrial aluminum cleaner, rinsed with tap water, and coated with a chromium oxide type conversion coating using a conversion coating solution of BONDERITE®713 (a product of Parker + Amchem). The chromium oxide conversion coating was applied according to the manufacturer's instruction. The chromium oxide conversion coating on the aluminum article was in the range of about 200 mg/ft$^2$.

The chromium oxide conversion coated aluminum article was rinsed, dried, then coated with a dispersion of a nylon polymer containing hydrophilic substituents to form a hydrophilic coating over the aluminum article. The coated aluminum article was aged for several days.

The chromium containing coating was removed by immersing the heat exchanger assembly in 5% sodium hydroxide solution at ambient temperature for 2 minutes, then immersing the article in an ultrasonic treating zone of 2 liters volume containing tap water for 5 minutes. The ultrasonic vibration in the treating zone was at 25 kilohertz during the treatment at a power level of 40 watts.

The chromium containing coating and the hydrophilic coating fell off the heat exchanger assembly in the ultrasonic bath and formed a readily filterable powder.

EXAMPLE 2

A heat exchanger assembly as in Example 1 was prepared as in Example 1 with a hydrophilic nylon coating over a chromium containing coating. An alkaline solution was prepared which contained

| Ingredients | % by weight |
|---|---|
| Sodium gluconate | 0.07 |
| Tetra Potassium Pyrophosphate | 1.5 |
| Potassium hydroxide | 1.5 |
| TRITON ® DF-20 (anionic surfactant) | 0.22 |
| PLURONIC ® L-61 (nonionic surfactant) | 0.07 |
| Water | 96.64 |

The pH of the solution was 12.9. The heat exchanger assembly was contacted with the alkaline solution by submerging the heat exchanger assembly in the solution with agitation for 5 minutes at 30° C. The alkaline treating bath had a volume of 60 liters. The article was removed from the alkaline treating bath, rinsed and placed in the ultrasonic treating zone. The ultrasonic treating zone had a volume of 80 liters, was filled with tap water and the ultrasonic vibration was at 25 kilohertz at 1260 watts. After 10 minutes all of the coating fell from the heat exchange assembly as a fine powder.

After 600 ft$^2$ of aluminum, which had been prepared as above, were treated by the process, the alkaline treating solution and the tap water in the ultrasonic treating zone were analyzed for their chromium and aluminum content. The results of the analysis are shown in Table 1.

TABLE 1

| Metal Ions | Concentration ppm |
|---|---|
| Alkaline Solution | |
| Cr (Total) | 30 |
| Cr (Soluble-filtered solution) | 2 |
| Al (Total) | 750 |
| Al (Soluble-filtered solution) | 710 |
| Water in Ultrasonic Treating Zone | |
| Cr (Total) | 28 |
| Cr (Soluble-filtered solution) | <1 |
| Al (Total) | 7 |
| Al (Soluble-filtered solution) | <2 |

The above results clearly show that the major portion of the chromium is not soluble in either the alkali treating solution or in the aqueous solution in the ultrasonic coating removal zone. This makes the process of the present invention particularly advantageous in that the chromium can be removed from the solutions involved in the process as a solid which substantially reduces the disposal problems for the treating solutions. In addition, the treating solutions can be utilized for longer periods of time before they need be discarded due to the high solid content in the solution.

EXAMPLE 3

Aluminum Panels were prepared from Aluminum Alloy 3003 (Mn), 5052 (Mg), 2024 (Cu), 7075 (Zn) and 6061 (Mg+Si) (Major alloying elements shown in parenthesis adjacent the Alloy number). One panel of each alloy was treated with a chromium phosphate type conversion solution (BONDERITE ®407-47 product of Parker + Amchem) according to manufacturers instructions. One panel of each alloy was treated with a chromium oxide type conversion coating solution (BONDERITE ®713 a product of Parker + Amchem) according to manufacturers instructions. The coatings on the panels were in the range of 200 mg per square foot. After the conversion coating treatment, the panels were rinsed, dried and aged for more than 24 hours.

Each panel was immersed in the agitated alkaline solution of Example 2 for 2 minutes at 30° C., water rinsed then immersed in an ultrasonic treating zone containing tap water at 38° C. for 10 minutes. The ultrasonic treating zone had a volume of 2 liters and was operated at a frequency of 25 kilohertz and power of 40 watts.

Both the chromium phosphate type conversion coating and the chromium oxide type coating were completely removed from the panels by the treatment. Alloy 2024 generated a substantial amount of black smut on its surface. About 80% of the black smut on the surface of alloy 2024 was removed in the ultrasonic treating zone. Small amounts of smut which formed on the surface of the other alloys was completely removed in the ultrasonic treating zone.

EXAMPLE 4

The 2 liter ultrasonic treating zone was filled with the alkaline treating solution of Example 2. Ten aluminum alloy panels of the same alloys as in Example 3 were coated with the chromium phosphate type and chromium oxide type conversion coatings as in Example 3. The coatings were rinsed, dried and aged for more than 24 hours as in Example 3. The coating was about 200 mg. per square foot.

Each coated panel was immersed in the alkaline solution in the ultrasonic treating zone for 5 minutes at 38° C. After the ultrasonic treatment the panels were rinsed and dried.

The conversion coatings were completely stripped from the 3003, 5052, 7075 and 6061 alloys. The 7075 alloy showed significant smutting and etching which indicated that a less concentrated solution, lower temperature or shorter treating time is required.

The 2024 alloy had 80% of the chromium oxide type conversion coating removed and 60% of the chromium phosphate type coating removed by the treatment which indicated that a longer treatment time, higher temperature or more concentrated solution is required to remove 100% of the coating.

The treating bath was operated at a frequency of 25 kilohertz and the power was 40 watts.

EXAMPLE 5

Ten aluminum alloy panels coated and aged as in Example 3 were immersed in an agitated 5% by weight sodium carbonate solution at 50° C. for 5 minutes; followed by a warm water rinse and a ten minute immersion in an ultrasonic treating zone of 2 liters capacity (tap water) at 38° C. The ultrasonic frequency was 25 kilohertz and the power 40 watts.

The chromium phosphate type coating was completely removed from alloys 7075, 3003, and 6061, 85% removed from alloy 5052 and 20% from alloy 2024.

The chromium oxide type coating was completely removed from the 7075 alloy. Fifty to 95% of the chromium oxide type coating remained on the other alloys.

EXAMPLE 6

Alloy test panels were prepared as in Example 3. The prepared test panels were immersed in the alkaline treating solution of Example 2 for 30 seconds at 30° C., rinsed and immersed in tap water in a 2 liter ultrasonic treating zone for 10 minutes at 38° C. The ultrasonic treating zone was operated at 25 kilohertz and 40 watts.

The chromium phosphate type coating was completely removed from alloys 3.003, 6061 and 7075 and the chromium oxide type coating was completely removed form alloy 6061 and 7075.

The coating removal from the other alloy panels ranged from 5 to 70%.

EXAMPLE 7

Example 6 was repeated with the addition of oxidizing agents to the alkaline treating solution. In separate tests, 0.2% by weight of sodium chlorate, hydrogen peroxide, or ammonium persulfate was added to the alkaline treating solution. The oxidizing agents did not significantly affect the removal of the coatings.

EXAMPLE 8

The aluminum alloy panels of the same types as in Example 3 were coated as in Example 3. Treating solutions of 5% by weight sulfuric acid, 5% by weight nitric acid and a solution of 5% by weight sulfuric acid and 0.25% by weight hydrofluoric acid were prepared.

The acid solutions were evaluated for removing the coatings from the aluminum alloy panels. Panels treated by immersion in the 5% sulfuric acid solution or in the 5% nitric acid solutions for 5 minutes at 30° C. retained more than 95% of the coating after the ultrasonic treatment for 10 minutes at 38° C. at a frequency of 25 kilohertz and 40 watts in a 2 liter ultrasonic treating zone.

The panels treated for 5 minutes at 30° C. with the solution of sulfuric and hydrofluoric acid had 40% to 90% of the coating removed in the ultrasonic treating zone at 25 kilohertz and 40 watts. However, the aluminum surface was severely etched and pitted. The ultrasonic treatment did not significantly assist in removing the coating.

EXAMPLE 9

Aluminum alloy panels prepared as in Example 3 were treated in the 2 liter ultrasonic treating zone (tap water at 38° C.) for 30 minutes at 25 kilohertz and 40 watts without previous contact with an alkaline or acid solution.

The ultrasonic treatment did not remove any of the chromium phosphate type or chromium oxide type conversion coatings from any of the alloy panels.

EXAMPLE 10

Ten aluminum alloy panels as in Example 3 were coated, rinsed and dried and aged as in Example 3. The panels were immersed in a 5% by weight sodium silicate solution ($Na_2O/SiO_2$ ratio 1:1) for 10 minutes at 50° C. followed by a warm water rinse and treatment in a 2 liter ultrasonic treating zone in tap water at 38° C. The ultrasonic frequency was 25 kilohertz at 40 watts.

Less than 10% of the chromium phosphate type conversion coating was removed from any of the aluminum alloy panels.

About 80% to 90% of the chromium oxide type conversion coating was removed from all of the alloy panels. The chromium oxide type conversion coated panels were badly etched and smutted. The chromium oxide type coating dissolved in the sodium silicate solution.

The above examples clearly show the effect of the process of the invention on the broad range of aluminum alloys with different types of chromium containing conversion coatings. The optimum condition for removing a coating from a particular aluminum alloy can be readily determined by modification of the above examples.

We claim:

1. A process for removing a chromium containing coating from an aluminum article which comprises: contacting the aluminum article having a chromium containing coating, with an aqueous alkaline treating solution at a pH above 10 for a sufficient time to form an aluminum article with an ultrasonically removable chromium containing coating; and treating the aluminum article, with the ultrasonically removable coating, with ultrasonic vibrations to remove the chromium containing coating.

2. A process of claim 1 wherein the coating is removed as particulate matter.

3. A process of claim 1 wherein the treating solution comprises an alkali metal hydroxide solution containing from about 0.2 to about 15% by weight of an alkali metal hydroxide.

4. A process of claim 2 wherein the treating solution comprises an alkali metal hydroxide solution containing from about 0.2 to about 15% by weight of an alkali metal hydroxide.

5. A process of claim 3 wherein the alkali metal hydroxide containing solution comprises at least one of sodium hydroxide and potassium hydroxide.

6. A process of claim 4 wherein the alkali metal hydroxide containing solution comprises at least one of sodium hydroxide and potassium hydroxide.

7. A process of claim 1 wherein the aluminum article is contacted with the alkaline treating solution and with ultrasonic vibrations concurrently.

8. A process of claim 2 wherein the aluminum article is contacted with the alkaline treating solution and with ultrasonic vibrations concurrently.

9. A process of claim 1 wherein the aluminum article with the ultrasonically removable coating is submerged in an aqueous bath and subjected to ultrasonic vibrations.

10. A process of claim 2 wherein the aluminum article with the ultrasonically removable coating is submerged in an aqueous bath and subjected to ultrasonic vibrations.

11. A process of claim 9 wherein the aqueous bath comprises water.

12. A process of claim 10 wherein the aqueous bath comprises water.

13. A process of claim 9 wherein the aqueous bath comprises an aqueous desmutting composition.

14. A process of claim 1 wherein the aqueous alkaline treating solution is at a temperature of from about 15° C. to about 90° C.

15. A process of claim 8 wherein the treating solution is at a temperature in the range of about 20° C. to about 80° C.

16. A process of claim 14 wherein the aqueous treating solution comprises at least one member selected from the group consisting of sodium hydroxide and potassium hydroxide.

17. A process of claim 16 wherein the aluminum article is contacted with the treating solution and ultrasonic vibrations concurrently.

18. A process of claim 1 wherein the treating solution comprises sodium carbonate.

19. A process of claim 1 were in the treating solution comprises an alkali metal salt of a phosphorus containing acid.

20. A process of claim 19 wherein the salt of a phosphorus containing acid compromises at least one member selected from the group consisting of trisodium phosphate and tetrapotassium pyrophosphate.

* * * * *